US009493995B2

(12) United States Patent
Hamed

(10) Patent No.: US 9,493,995 B2
(45) Date of Patent: Nov. 15, 2016

(54) WRENCH EXTENSION WITH FOOT SUPPORT

(71) Applicant: Afshin Hamed, Calgary (CA)

(72) Inventor: Afshin Hamed, Calgary (CA)

(73) Assignee: Gearench Division of Orbix Corporation, Clifton, TX (US)

( * ) Notice: Subject to any disclaimer, the term of this patent is extended or adjusted under 35 U.S.C. 154(b) by 319 days.

(21) Appl. No.: 14/468,444

(22) Filed: Aug. 26, 2014

(65) Prior Publication Data

US 2016/0060983 A1 Mar. 3, 2016

(51) Int. Cl.
*B25G 1/10* (2006.01)
*E21B 19/16* (2006.01)

(52) U.S. Cl.
CPC ..... *E21B 19/161* (2013.01); *B25G 1/102* (2013.01)

(58) Field of Classification Search
CPC ..... B25G 1/02; B25G 1/005; B25G 1/002; B25G 1/043; B25G 1/102; E21B 19/161; B25B 13/481
See application file for complete search history.

(56) References Cited

U.S. PATENT DOCUMENTS 3,973,283 A * 8/1976 Boe ..... B25G 1/007 254/131
4,738,167 A * 4/1988 Ball ..... B25B 7/00 81/124.2
5,535,649 A * 7/1996 Waggle, Jr. ..... B25G 1/043 81/177.2
5,910,198 A * 6/1999 Maher ..... B60B 29/007 81/180.1
5,967,005 A * 10/1999 DeVore ..... B60B 29/007 81/180.1
6,308,596 B1 * 10/2001 Williams ..... B25G 1/043 81/177.1
8,286,535 B1 * 10/2012 McCartney ..... B25B 13/00 254/21
8,601,913 B2 * 12/2013 Armes ..... B25B 13/28 81/177.2
8,931,376 B2 * 1/2015 Humphrey ..... B25G 1/043 81/177.2
9,327,387 B2 * 5/2016 Shah ..... B25B 3/00 269/4
2010/0000377 A1 * 1/2010 Barks, Sr. ..... B25B 13/06 81/121.1

* cited by examiner

*Primary Examiner* — David B Thomas

(57) ABSTRACT

The present invention is an add-on tool to the standard barrel wrench that comprises a heavy duty T-shaped member and a foot ring where the operator fits their foot into the ring and applies force. Using the device of the present invention the operator no longer needs to stand on an angled surface and hope the barrel will instantly snap open after a few bounces without slipping and falling. The interior diameter (ID) of the foot ring of the device is about 6.5 inches which offers plenty of room for the operator to insert their foot in and apply pressure to the Barrel.

20 Claims, 10 Drawing Sheets

WRENCH EXTENSION WITH FOOT SUPPORT

BACKGROUND OF THE INVENTION

1. Field of the Invention

The present invention relates generally to a wrench extension, and more particularly to a wrench extension with a foot ring that eliminates the risky procedure of the wrench use during operation by securing the operator's foot.

2. Description of Related Art

Measurement-While-Drilling (or MWD) is a type of well logging that incorporates the MWD tools into the drill string and provides real-time information to help with steering the drill.

A standard barrel wrench (or friction tong) as shown in FIG. 1 is used to disassemble and assemble the MWD tool. It is an important and critical step in disassembling and assembling an MWD tool. To make sure the MWD tool will handle rugged downhole conditions and high vibrations the operators are obligated to satisfy the required foot pounds (commonly minimum 300 ft.-lbs.) as per company's strict procedures.

The main disadvantage of the standard barrel wrench (friction tongs) is the limited control and force it can deliver. From time to time, the barrels of the tool are close to impossible to disassemble. This is mainly caused by the amount of down hole hours, the high temperature it operates under, in addition to a few other factors that cause the MWD assembly to be fastened firmly.

When an operator encounters an MWD tool that is fastened firmly, despite the wrench manufacture's warnings, they choose to stand on the handle of the wrench as shown in FIG. 2 and either lean with their foot or slightly bounce on it. 90% of the time, this unsafe risky procedure works. However, there is a high risk for a serious accident from standing on the barrel wrench with no support. The foot can slide, and the operator can lose balance, the barrel disassembles and injuries could be caused.

The operators work in all sorts of weather conditions, including harsh winters where snow and ice can be everywhere and during the summer rainy days, when the lease and the work area is wet filled with mud and grease. All these conditions factor in, and increase the chances of having a slip and fall incident. Now imagine the image shown in FIG. 2 with operator's boots covered with mud, grease or ice, it makes the procedure a lot more hazardous and difficult.

Safety is every company's number one priority. Taking this step and improving the use of the barrel wrenches is an important phase in making sure that operators do not get injured while doing their job. Not only is that hazardous to the well being of the employee, but an employee injured on a job, causes down time and with downtime comes expensive costs followed by unsatisfied clients and the involvement of Workers Compensation Board.

Statistically, over the course of an operator's employment 80% seriously injure themselves without filing an incident report. 15% break or fracture part(s) of their body. Only 5% get fortunate.

Therefore, it is necessary to have a device that can improve safety of MWD operators and prevent MWD operators from getting injured. In the meantime, the device should improve the efficiency of operating the barrel wrench and increases the control and force that a barrel wrench can deliver.

SUMMARY OF THE INVENTION

An object of this invention is to provide apparatus and method for eliminating risky procedure of the barrel wrench use during operation.

Another object of this invention is to provide apparatus and method for avoiding slips and falls of the barrel wrench during operation.

Another object of this invention is to provide apparatus and method for increasing control and force that the barrel wrench can deliver during operation.

Another object of this invention is to provide apparatus that is portable and easy to use.

Yet another object of this invention is to provide apparatus that can be customized to fit every existing friction wrench.

In an exemplary embodiment of the present invention, there is disclosed a wrench extension with a foot ring (as shown in FIGS. 3-5) designed for use with barrel wrench. The wrench extension eliminates the risky procedure of the barrel wrench (friction tongs) use during operation by securing the operator's foot.

The present invention is an add-on tool to the standard barrel wrench that comprises a heavy duty T-shaped member and a foot ring where the operator fits their foot into the ring and applies force. Using the device of the present invention the operator no longer needs to stand on an angled surface and hope the barrel will instantly snap open after a few bounces without slipping and falling. The interior diameter (ID) of the foot ring of the device is about 6.5 inches which offers plenty of room for the operator to insert their foot in and apply pressure to the Barrel.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 3:
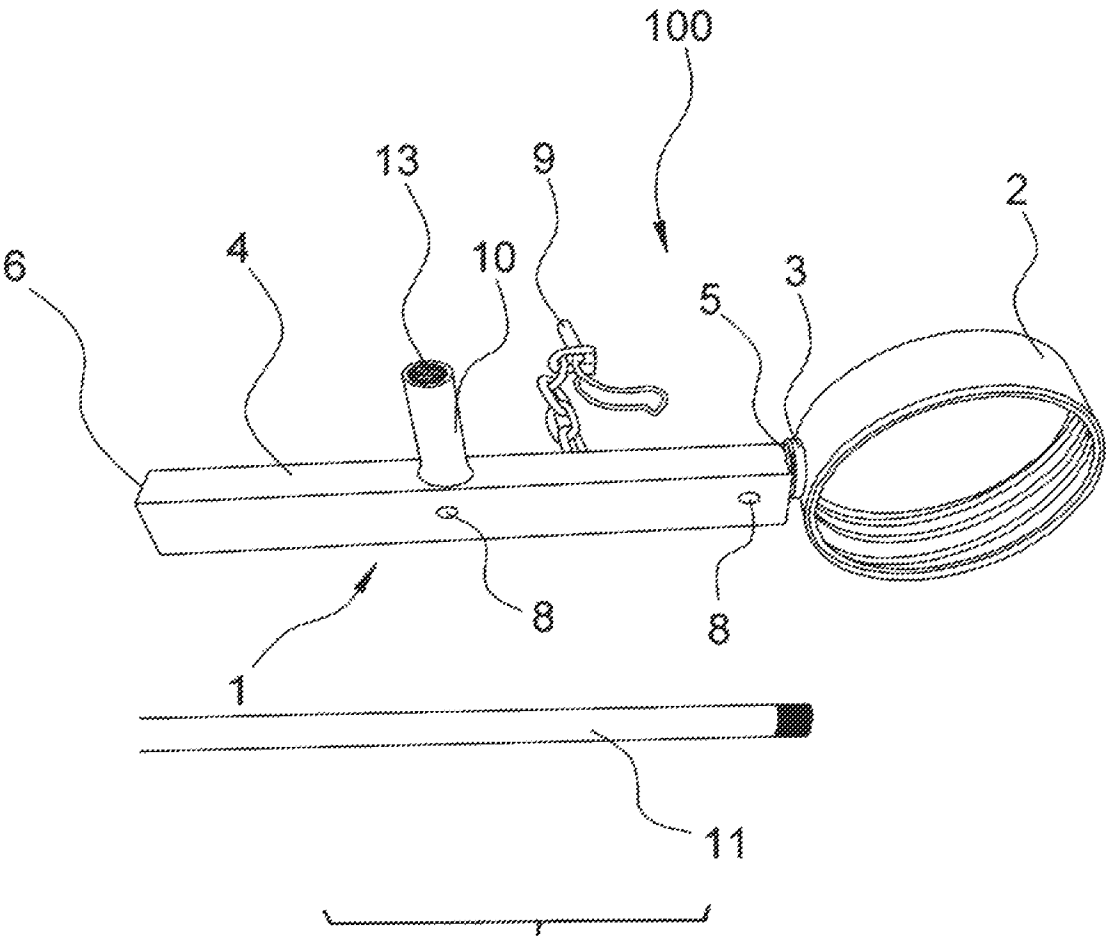
FIG. 3 is an exploded view of the device (a wrench extension with foot support) according to one embodiment of the present invention wherein the handle bar is separate from the heavy duty tube.
Figure 4:
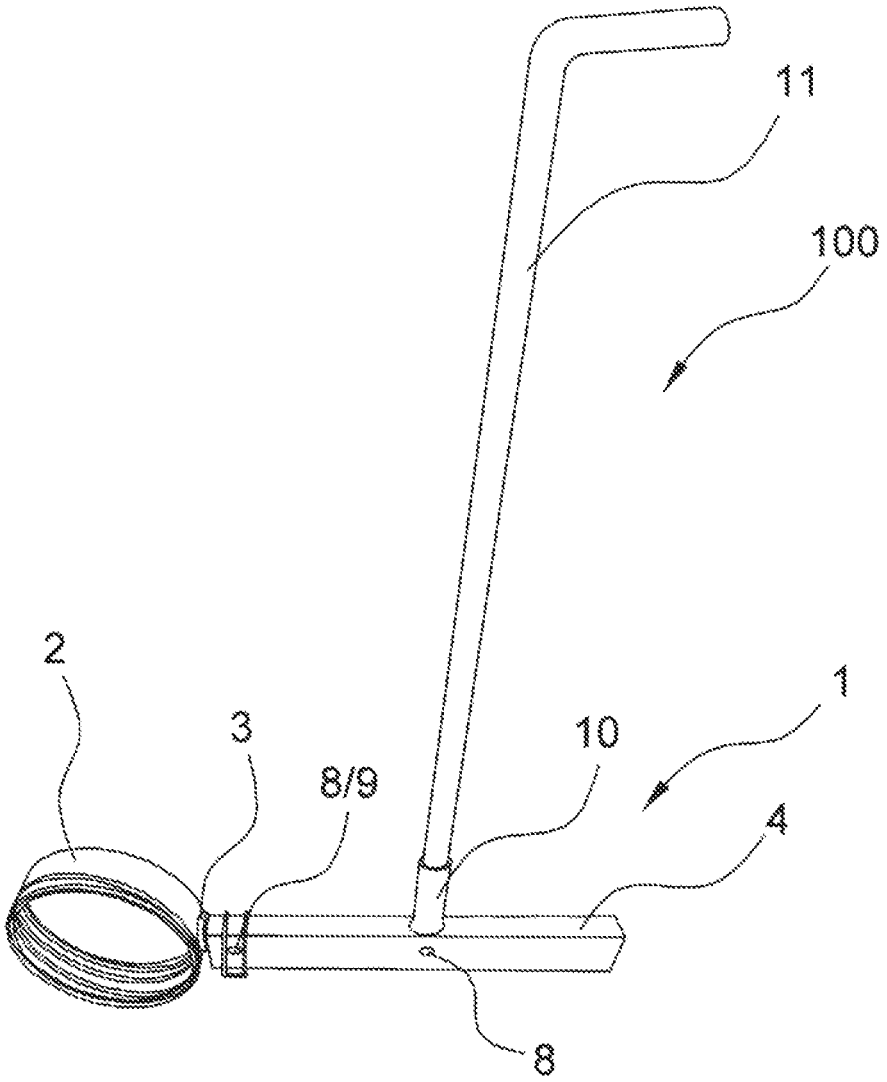
FIG. 4 is a perspective view of the device (a wrench extension with foot support) according to one embodiment of the present invention wherein the handle bar is attached to the heavy duty tube via the handle hole project.
Figure 5:
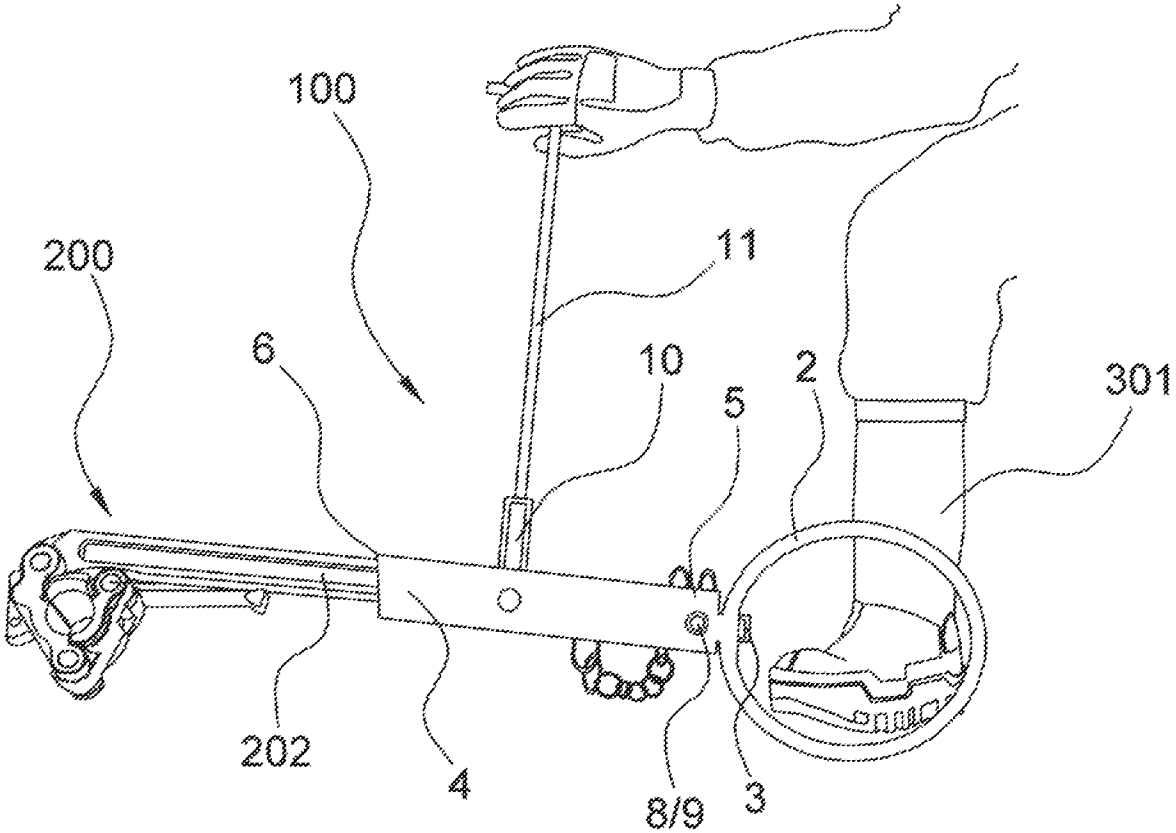
FIG. 5 is a perspective view of the device attached to the handle of the prior art barrel wrench wherein an MWD operator is inserting one foot in the foot ring and holding the handle bar of the device.

Referring to FIGS. 3-5, there is disclosed a wrench extension with foot support 100 in accordance with the present invention comprising a heavy duty T-shaped member 1, a heavy duty link 2 connected to the T-shaped member 1, and a foot ring 3 connected to the heavy duty link 2. The heavy duty T-shaped member 1 includes a hollow elongated tube 4 having a closed end 5 and an open end 6; the closed end 5 is connected to the heavy duty link 2, and the open end 6 is adapted to receive a handle 202 of a wrench 200. The foot ring 3 having foot grips 7 on the interior surface providing the operator's foot 301 extra grip is designed to allow the operator to fit their foot into and applies force to the wrench handle 202 therein. The shape and dimensions of the elongated tube 4 can be customized to fit every existing friction wrench and can be used in a variety of fields.

Figure 1:
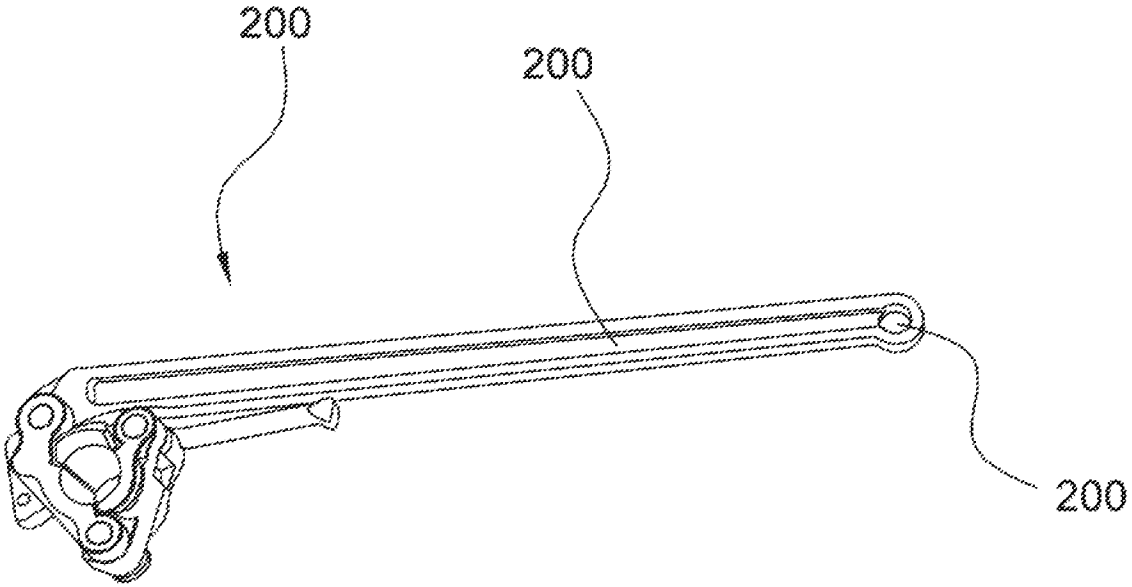
FIG. 1 is a perspective view of a prior art standard barrel wrench.
Figure 2:
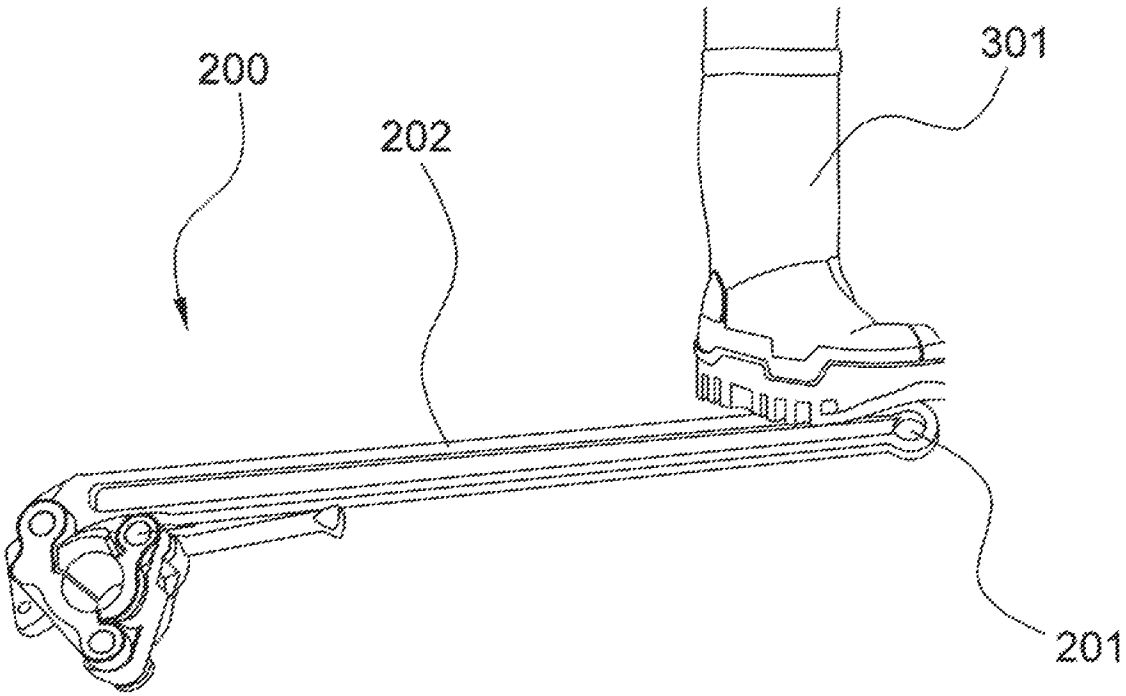
FIG. 2 is a perspective view of an MWD operator standing on the handle of the prior art barrel wrench.

The heavy duty T-shaped member 1 further has one or more safety pin holes 8 along the elongated tube 4 for receiving the safety pin(s) 9 that is/are attached to the heavy duty tube 1 in order to secure the heavy duty tube 1 and the wrench handle 202 therein and prevent the wrench 200 from skidding. As shown in FIGS. 4 and 5, the safety pin 9 goes into the safety pin hole 8 on the heavy duty tube and into the hole 201 on the wrench handle (not observable in FIG. 5, referring to FIG. 2 for the hole 201) so that the wrench handle is secured in place within the heavy duty T-shaped member. In one embodiment, the safety pin holes 8 are located near the closed end 6 of the elongated tube and near the short tube 10.

The revolving design of the foot ring 3 relative to the heavy duty T-shaped member 1 allows the ring to follow where the operator's foot goes. The revolving design may be achieved by having the foot ring 3 revolvingly connected to the heavy duty link 2. There may be other mechanisms known in the art to achieve the revolving design.

The heavy duty T-shaped member 1 further includes a hollow short tube 10 which is perpendicularly connected to the middle of the elongated tube 4 for receiving a separate handle bar 11 which is designed to be held by the operator's hand 302 so as to assist the operator to keep balance and control. In one embodiment, the handle bar 11 has screw threads 12 on one end to match the screw threads 13 on the short tube 10 so that the handle bar 11 is secured in place to the heavy duty T-shaped member. Other securing means known in the art may be used.

In one embodiment, the foot ring 3 has about 6.5 inches ID, 7.0 inches OD (outer diameter) and 2.0 inches in width. The total length of the device 100 is about 22 inches. The maximum working load of the device 100 is about 5,000 ft.-lbs. which exceeds the 2,300 ft.-lbs. of the standard barrel wrench only.

In other embodiment, the foot ring 3 may be replaced by a foot pedal or other type of foot support that allows the operator to step on and apply force.

The device of the present invention can be customized to fit every existing friction wrench and can be used in other fields.

Referring to FIGS. 6-9, there is disclosed a method of eliminating the risky procedure of barrel wrench use during operation by securing the operator's foot. The method achieves the goal using the device of the present invention which is a wrench extension with foot support.

Figure 6:
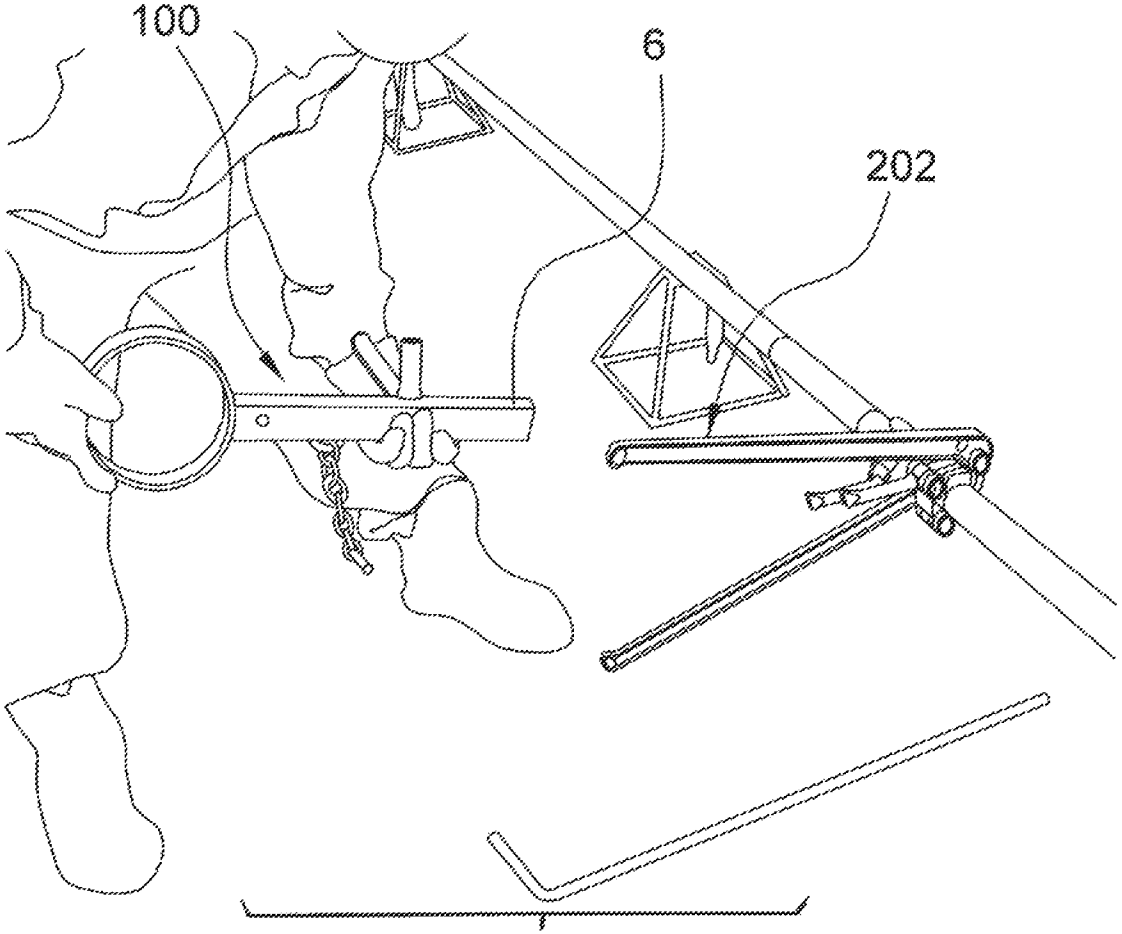
FIG. 6 is a perspective view showing an MWD operator holding the device and ready to slide the device onto the handle of the barrel wrench.
Figure 7:
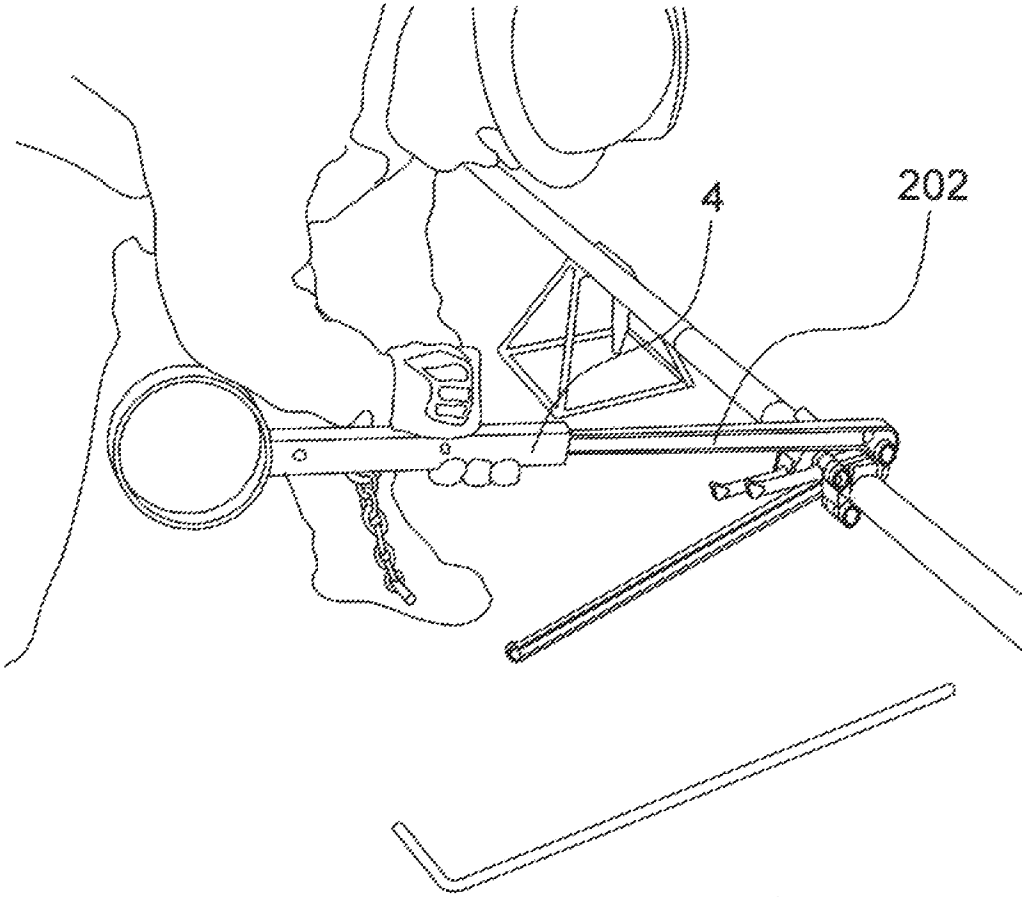
FIG. 7 is a perspective view showing the MWD operator is sliding the device onto the handle of the barrel wrench.
Figure 8:
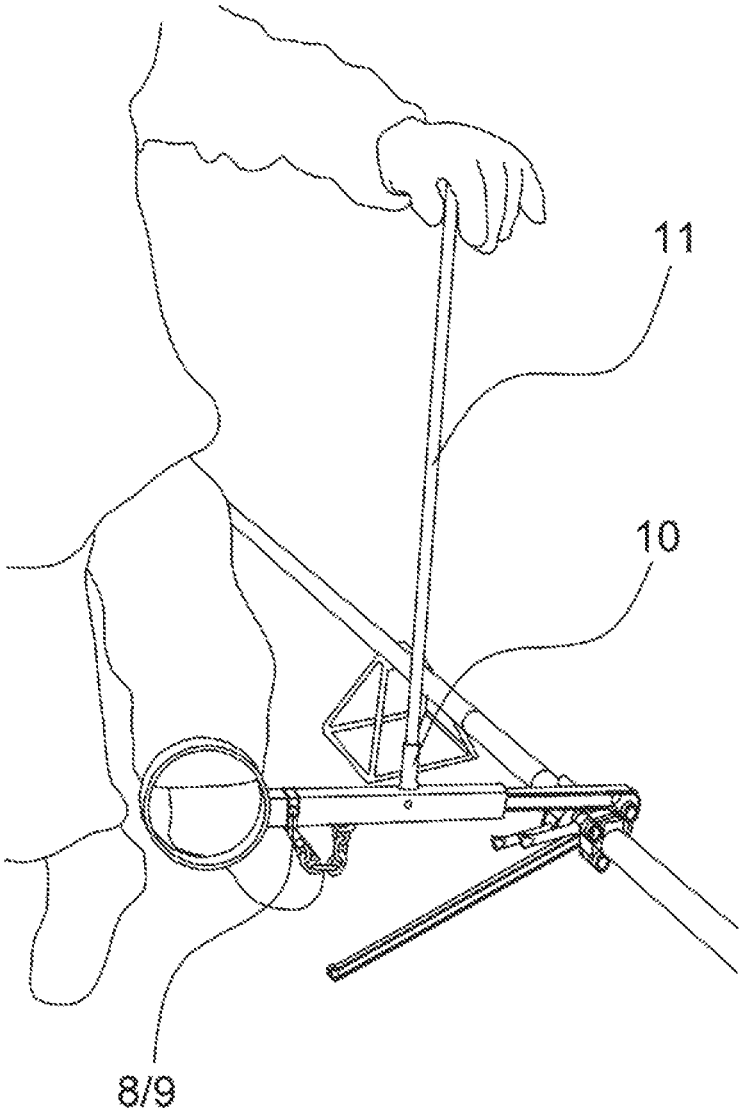
FIG. 8 is a perspective view showing the MWD operator inserting the handle bar into the handle hole of the device wherein the safety pin is inserted into the preferred safety pin hole to secure the wrench to the device.
Figure 9:
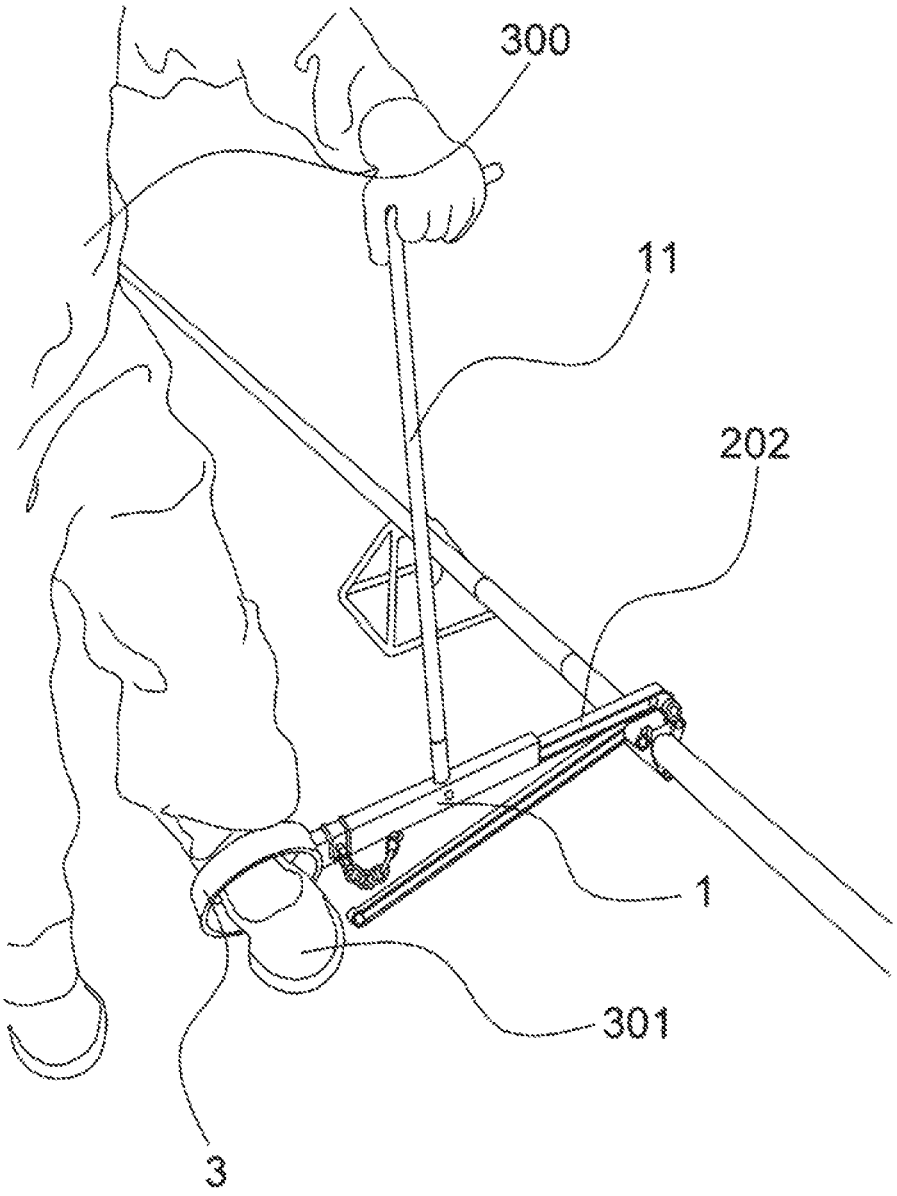
FIG. 9 is a perspective view showing the MWD operating inserts his foot and applies force to the barrel wrench.
Figure 10:
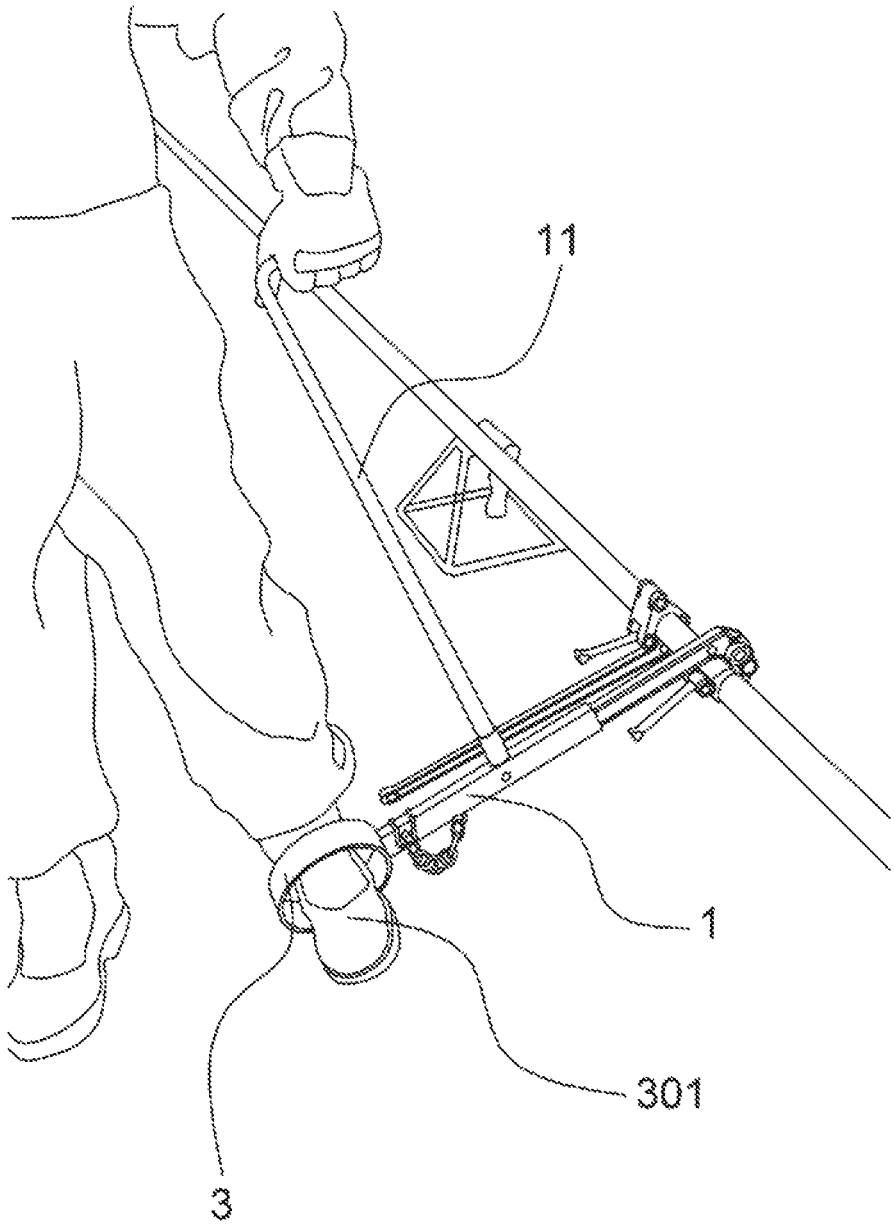
FIG. 10 is a perspective view showing the MWD operating inserts his foot and applies force to the barrel wrench wherein the relative position between the foot ring and the heavy duty T-shaped member is different from that in FIG. 9.

First, the operator 300 holds the device 100 in a way that the open end 6 of the heavy duty T-shaped member 1 faces toward the terminal of the wrench handle 202 (see FIG. 6.) Then, the operator slides the elongated tube 4 towards the wrench handle 202 such that a major part of the wrench handle 202 is located inside the elongated tube 4 (see FIG. 7). Next, depending on the position of the hole 201 on the wrench handle, the operator chooses the preferred safety pin hole 8 on the elongated tube and inserts the safety pin 9 into the preferred safety pin hole 8 and into the hole 201 (not observable in the FIG.) in the wrench handle to secure the wrench to the device. After the wrench 200 is secured to the device 100, the operator firmly sets the handle bar 11 into the short tube 10 (see FIG. 8). While holding the handle bar 11 to keep balance and control, the operator 300 then inserts his foot 301 into the foot ring 3 and steps on the foot ring to apply force to the wrench handle therein whereby executing the disassembly or assembly of MWD tool (see FIGS. 9 and 10). As illustrated in FIGS. 9 and 10, the revolving design of the foot ring 3 relative to the heavy duty T-shaped member 1 allows the ring 3 to follow where the operator's foot goes. The relative position between the foot ring 3 and the heavy duty T-shaped member 1 in FIG. 10 is different from that in FIG. 9.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed.

Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

Any modification made to the friction wrench including fundamental novel features of this invention are within the scope of the invention when interpreted in accordance with the breadth to which they are entitled.

What is claimed is:

1. A wrench extension with foot support for increasing safety and force during operation of the wrench comprising:

a heavy duty T-shaped member having a hollow elongated tube with one closed end and one open end for receiving a wrench handle, and a hollow short tube perpendicularly connected to the elongated tube;

a heavy duty link having a first end connected to the closed end of the elongated tube;

a foot support connected to a second end of the heavy duty link; and a handle bar once inserted into the short tube of the heavy duty T-shaped member enabling the operator to keep balance and control by holding it;

wherein the foot support is designed for the operator to fit their foot in and apply force onto the wrench handle therein.

2. The device of claim 1, wherein the foot support is revolvingly connected to the heavy duty link allowing the foot support to follow where the operator's foot goes.

3. The device of claim 2, wherein the foot support is in a shape of a ring having foot grips providing the operator's foot extra grip.

4. The device of claim 3 further comprising securing mechanisms to secure the wrench handle to the device.

5. The device of claim 3 further comprising one or more safety pins attached to the elongated tube and one or more safety pin holes located on the elongated tube for securing the elongated tube of the device and the wrench handle therein whereby preventing the wrench handle from skidding.

6. The device of claim 5, wherein the handle bar has screwed threads to match screwed threads on the short tube for securing the handle bar to the short tube.

7. The device of claim 6, wherein the foot ring has about 6.5 inches ID, 7.0 inches OD, and 2.0 inches in width.

8. The device of claim 7, wherein the total length of the device is about 22 inches.

9. The device of claim 8, wherein the maximum working load of the device is about 5,000 ft.-lbs.

10. The device of claim 9, wherein the device can be customized to fit every existing friction wrench.

11. A method of increasing safety and applied force during operation of the wrench comprising:

providing a device including a heavy duty T-shaped member which has a hollow elongated tube with a closed end connected to a foot support via a heavy duty link and an open end for receiving a wrench handle, and a hollow short tube perpendicularly connected to the elongated tube for receiving a handle bar;

sliding the device onto the wrench handle in an orientation that the open end of the elongated tube faces toward the end of the wrench handle;

securing the elongated tube and the wrench handle therein in place by securing means;

inserting the handle bar into the short tube and securing the handle bar in place; and inserting a foot into the foot support and applying force while holding the handle bar to keep balance and control.

12. The method of claim 11, wherein the foot support is revolvingly connected to the heavy duty link allowing the foot ring to follow where the operator's foot goes.

13. The method of claim 12, wherein the foot support is in a shape of a ring having foot grips providing the operator's foot extra grip.

14. The method of claim 13 wherein the device further includes securing mechanisms to secure the wrench handle to the device.

15. The method of claim 13 wherein the device further includes one or more safety pins attached to the elongated tube and one or more safety pin holes located on the elongated tube for securing the elongated tube of the device and the wrench handle therein whereby preventing the wrench handle from skidding.

16. The method of claim 15, wherein the handle bar has screwed threads to match screwed threads on the short tube for securing the handle bar to the short tube.

17. The method of claim 16, wherein the foot ring has about 6.5 inches ID, 7.0 inches OD, and 2.0 inches in width.

18. The method of claim 17, wherein the total length of the device is about 22 inches.

19. The method of claim 18, wherein the maximum working load of the device is about 5,000 ft.-lbs.

20. The method of claim 19, wherein the device can be customized to fit every existing friction wrench.

* * * * *